United States Patent [19]

Witteman et al.

[11] Patent Number: 4,560,165

[45] Date of Patent: Dec. 24, 1985

[54] GOLF PRACTICE DEVICE

[76] Inventors: Frank Witteman, 372 Franklin Ave., Redlands, Calif. 92373; Richard T. Witteman, P.O. Box 1164, Santa Fe, N. Mex. 87501; Donald F. Witteman, 5089 Fallhaven La., La Canada, Calif. 91011

[21] Appl. No.: 498,926

[22] Filed: May 27, 1983

[51] Int. Cl.[4] ..... A63B 69/36

[52] U.S. Cl. ..... 273/183 A; 273/187 R; 272/146

[58] Field of Search ..... 272/146, DIG. 5; 273/187 R, 185 D, 183 A; 128/25 B

[56] References Cited

U.S. PATENT DOCUMENTS

| | | | |
|---|---|---|---|
| 628,236 | 4/1899 | Warren | 273/185 D X |
| 2,189,613 | 2/1940 | Paulsen | 273/187 R |
| 2,256,001 | 9/1941 | Titus | 272/146 |
| 2,573,808 | 11/1951 | Ravoire | 434/253 |
| 2,637,319 | 5/1953 | Bruene | 272/146 X |
| 3,100,639 | 8/1963 | Bonewitz | 272/146 |
| 3,207,510 | 9/1965 | Gibson | 434/253 X |
| 3,352,559 | 11/1967 | Larsen | 273/187 R |
| 3,415,523 | 12/1968 | Boldt | 273/186 R |
| 3,421,760 | 1/1969 | Freeman | 128/25 B |
| 3,702,188 | 11/1972 | Phillips et al. | 272/146 |
| 3,784,193 | 1/1974 | Simjian | 272/68 |
| 3,911,907 | 10/1975 | Smith | 272/146 |
| 4,037,847 | 7/1977 | Lorang | 273/187 B |
| 4,199,137 | 4/1980 | Giguere | 128/25 B X |
| 4,209,167 | 6/1980 | Jansen | 272/DIG. 5 |

*Primary Examiner*—George J. Marlo
*Attorney, Agent, or Firm*—Lyon & Lyon

[57] ABSTRACT

A golf practice device with a platform for the golfer to stand on rotatably mounted on a base with interengaging stops on the platform and base for allowing only a small angle of movement therebetween. An adjustable tension spring extends below the base and platform to provide a preselected force against rotation. By the golfer standing on the platform and swinging a club, the proper torque is created at the start of the downswing if the platform rotates overcoming the spring tension. In one form an electrical circuit provides an audible or visual indication of that rotation.

11 Claims, 8 Drawing Figures

GOLF PRACTICE DEVICE

BACKGROUND OF THE INVENTION

1. Field of the Invention

This invention relates to a device which improves a golfer's swing by allowing the golfer to practice on the device until the golfer's body pivots in such a manner so as to provide a sufficient torque in the downswing. Further, this invention permits the golfer to achieve a body movement which creates the desired torque for various shots.

2. Description of the Prior Art

Mechanical golf practicing devices are not new to the world of golfing. In the past, several devices have been developed so as to allow the golfer to practice and achieve a correct weight distribution during his swing. Additionally, such devices have utilized a platform which would tilt relative to its base, the tilt being caused by the weight shift of the golfer during backswing and downswing. Two examples of such devices are described and illustrated in U.S. Pat. Nos. 3,352,559 to E. A. Larsen and 4,037,847 to Walter R. Lorang. Another training device which utilizes a weight distribution system along with other more complicated means to control a swing, including a head restraint, is disclosed in U.S. Pat. No. 3,415,523 to A. M. Boldt. means to control a swing, including a head restraint, is disclosed in U.S. Pat. No. 3,415,523 to A. M. Boldt.

Other mechanical devices designed for golfers in the past have focused on trying to condition the golfer's body. One such device, described in U.S. Pat. No. 3,784,193 to Luther G. Simijian, allowed golfers to tune up muscles by rotating a platform in response to a twisting motion while the golfer's extended arm was clutching a stationary or semi-stationary part of the device.

Such mechanical sports training devices are not known solely to golfers. Several other sports also use mechanical training devices in order to improve the skill of the athlete. One such sport in which mechanical devices are used is skiing. Ski training devices have been designed in which the feet of the skier are mounted for various movements. In U.S. Pat. No. 2,573,808 to R. Ravoire, a pair of parallel treadles are mounted for limited forward rotation in two parallel vertical planes as well as rotation in a horizontal plane, thus simulating a ski turn. Numerous other devices have also been devised in today's computer world which utilize computer programming and analysis to create computerized exercise equipment and ultra-sophisticated measuring devices so as to allow an athlete to improve performance.

Finally, exercisers have been devised in which a platform is rotated by twisting the body of an exerciser. One such device is described in U.S. Pat. No. 3,100,639 to E. D. Bonewitz.

SUMMARY OF THE INVENTION

It is recognized by golfers that the proper use of the legs is essential in generating a powerful golf swing. Although it is possible to play a good game of golf from the hips upwards, a golfer must have good form from the hips down in order to generate the correct torque necessary to be a first class golfer.

The present invention is designed so as to analyze the torque created by the swing of a golfer and allow the golfer to practice and achieve the correct torque.

A full golf swing with a wood club has been found to generate approximately 35 lbs. of torque, although this may vary somewhat as to the strength of the golfer. It has also been found that the best results utilizing this device have been achieved at 20 lbs. of torque, the torque being reduced to 10 lbs. when practicing short irons and chip shots.

In this invention, a platform which is rotatably mounted on a base is connected to a tensioning device which provides a force to retard movement of the platform during the swing of a golfer. When a sufficient torque is applied to the platform so as to overcome the tension created by the tensioning device, the platform will rotate until it is stopped by either a physical stop or by the tension of the tensioning means. Thus, the tensioning means can be adjusted so as to provide a tension which should be applied to the platform during the downswing of a golfer. When this tension has been reached, an indicator will so indicate to the golfer.

The torque applied to the platform is created by the movement of the golfer's body during the start of the downswing following the backswing. However, when the golfer does not generate sufficient torque, the tensioning means may be reduced so as to allow the golfer to gradually work up to the desired torque. Also, should a golfer have too much movement in the downswing, a torque greater than the desired amount will result. To test whether or not this additional torque is being generated, once the golfer has been able to generate enough torque to trigger the indicator, the tension on the platform may be increased. If the indicator is still activated, the golfer will then know that there is too much movement in the downswing and therefore such movement should be reduced so as to reduce the torque. Thus, it should be apparent that the optimal amount of torque may be achieved by practice on this device and the golfer will develop the habit of swinging with that optimal torque thereby improving both the strength and consistence of his swing.

Additionally, since the golfer has a subconscious knowledge that he is standing on a movable platform at the top of the backswing, this invention gives the golfer a signal to initiate the downswing with both feet and legs.

DETAILED DESCRIPTION OF THE DRAWINGS

Figure 1:
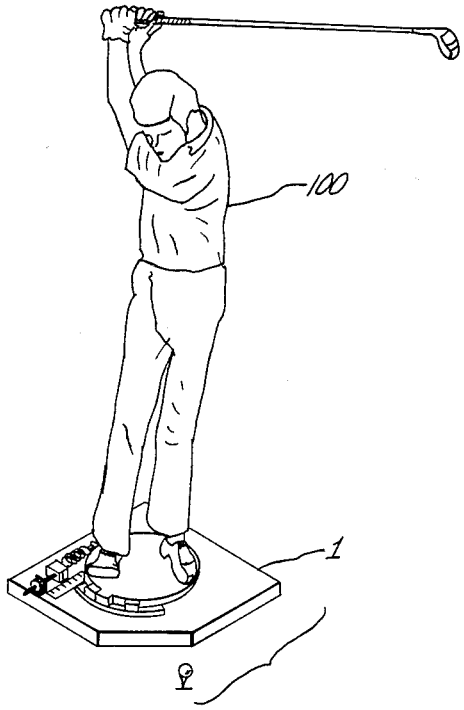
FIG. 1 is a perspective view of a preferred embodiment of the invention being used by a person standing thereon.
Figure 4:
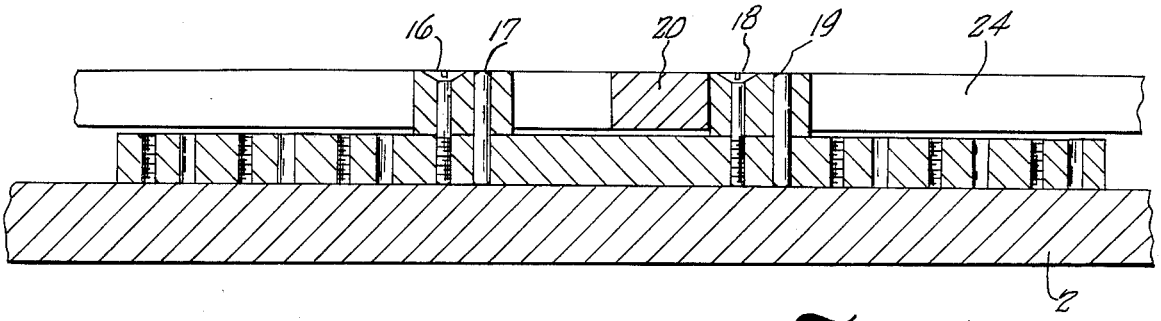
FIG. 4 is a sectional view along line 4—4 in FIG. 2.
Figure 5:
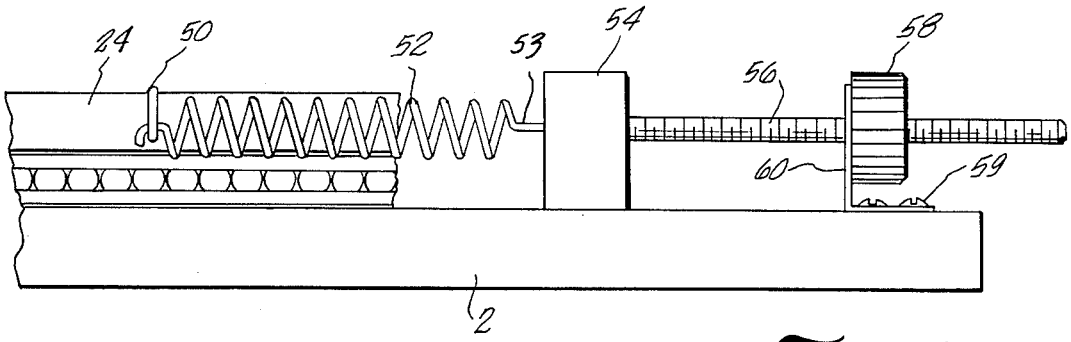
FIG. 5 is an elevation view along line 5—5 in FIG. 2.
Figure 6:
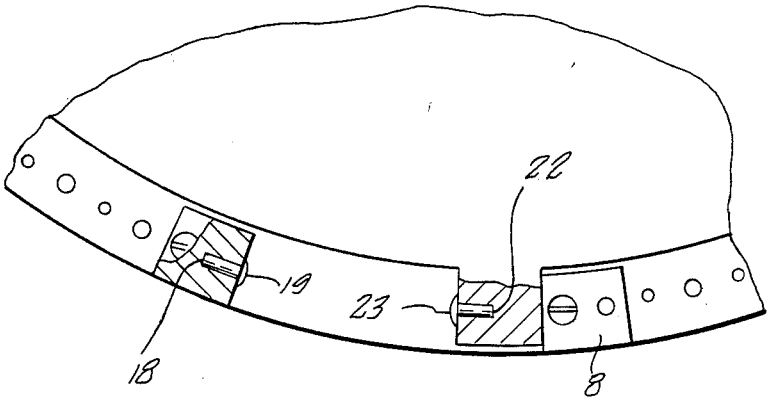
FIG. 6 is an enlarged partial plan view with a partial cutaway showing the indicator contacts.

Referring to the figures, FIG. 1 shows a golfer 100 standing upon the golf improvement device 1 designed for a right-handed golfer. It is to be understood the components will be reversed for a left-handed golfer to allow rotation in the opposite direction. The base 2 of this device is a horizontal board to which stop support 4 is attached by means of screws 6. Rest stop 8 is connected to stop support 4 by screw 18 and dowel 19. Movement stop 14 is attached to stop support 4 by screw 16 and dowel 17. Movement stop 14 may be a movement contact 18, shown in FIG. 6 as a metal stud, embedded within the movement stop with a metal contact 19 protruding outwardly from the movement stop.

Platform 24, which is preferably circular, is connected to base 2 via a lazy susan type bearing device 40. Indicator block 20 extends radially outwardly from platform 24 and has an indicator contact 22, shown in FIG. 6 as a metal stud, embedded within the indicator block. A metal contact 23 protrudes outwardly from the contact. The top portion 41 of the lazy susan device is affixed to platform 24 while the bottom portion 42 is connected to base 2. Ball bearings 43 are maintained between the top ball bearing groove 45 and the bottom ball bearing groove 46. While the present device utilizes a lazy susan type support device to connect the base 2 and platform 24, many other devices could be used instead. The device which connects base 2 and platform 24 should hold the two planar surfaces in a horizontally parallel configuration wherein the platform 24 can rotate clockwise or counter-clockwise with respect to base 2 which remains stationary during movement of the platform. However, the base need not necessarily be of a planar shape or parallel to the platform, but the platform must rotate in a horizontal plane. It is preferable that the connecting device allow for movement of the platform with a minimum of frictional resistance.

Affixed to platform 24 is a peg 50. A first end 51 of a tension spring 52 is connected to peg 50 while the second end 53 of the spring 52 is connected to a spring indicator means 54. The spring indicator means 54 is then attached to a threaded bolt 56 which passes through a hole in clamp 60. A tension adjusting means 58 is attached to threaded bolt 56 and abuts clamp 60 so as to maintain the spring 52 in an extended position. The clamp 60 is affixed to base 2, although it could just as well be affixed to any other stationary means, such as the ground for example. By screwing or unscrewing the adjusting means 58, the tension of the spring 52 will be adjusted while the indicator 54 will point to the tension scale 62.

Figure 2:
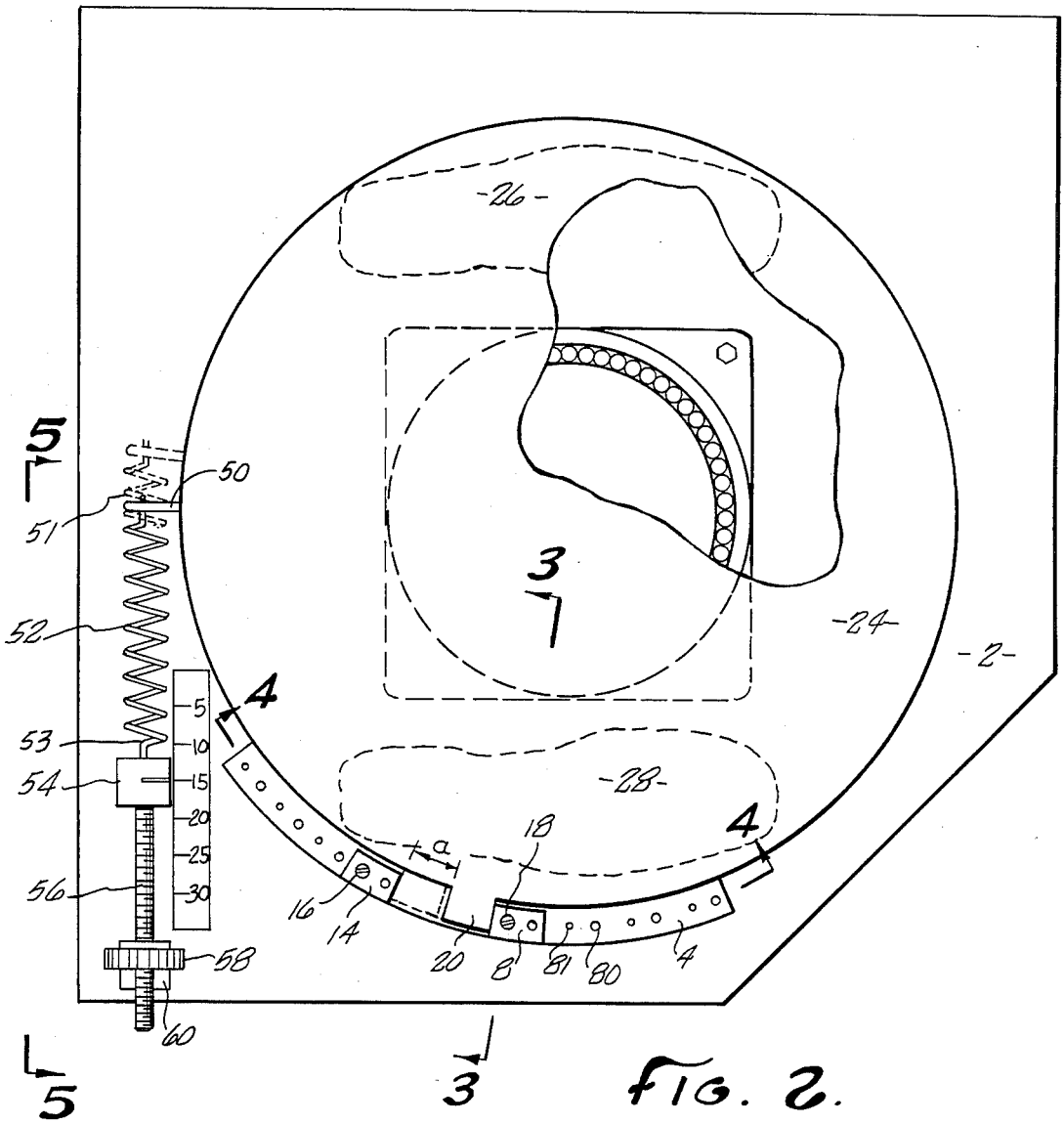
FIG. 2 is an enlarged plan view of the preferred embodiment with a partial cutaway.
Figure 3:
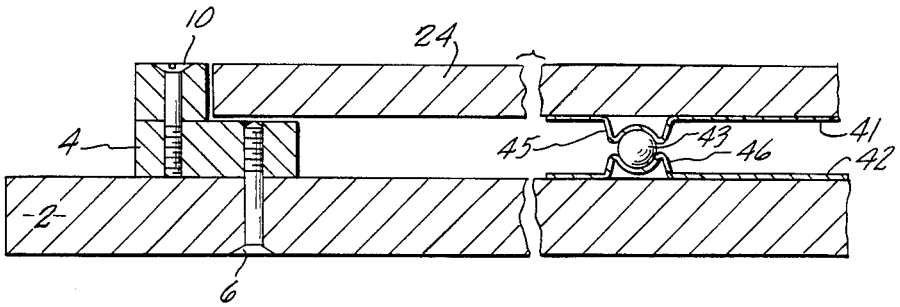
FIG. 3 is a sectional view along line 3—3 in FIG. 2.
Figure 7:
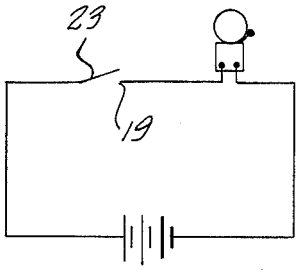
FIG. 7 is a schematic diagram showing an electrical circuit for use with the device and containing a bell.
Figure 8:
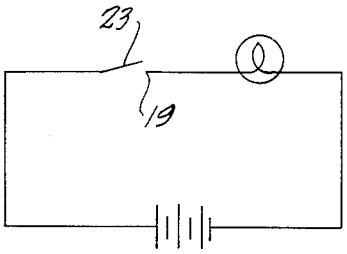
FIG. 8 is a schematic diagram showing an electrical circuit for use with the device and containing a light.

When a golfer 100 places his left foot in position 26 and his right foot in position 28, the peg 50 will be behind the golfer and the tension created by spring 52 will bias the indicator block 20 against rest stop 8, as is depicted in FIG. 2, in the resting position of the device. If a golfer begins his downswing with correct body motion, the movement of his body will generate a torque which will cause the platform to rotate in a clockwise direction with respect to the base. If sufficient torque is generated by the movement of the golfer, the indicator block 20 will move clockwise toward the movement block 14 and contact surface 23 will touch contact surface 19. Such a rotation is shown in FIG. 2 by arc "a". When this happens, an electrical circuit connected to indicator contact 22 and movement contact 18 will be closed. The closing of the circuit will generate a signal which will inform the golfer that a minimum of the set torque has been obtained. The golfer may be alerted by a bell or a flashing light. A circuit for a bell is shown in FIG. 7 while a light circuit is shown in FIG. 8. After the torque generated by the movement of the golfer's swing is decreased to a point wherein the tension created by spring 52 is no longer overcome, the indicator block and the platform will move counter-clockwise and the indicator block contact 23 will no longer be in electrical contact with movement contact surface 19.

It should be noted that the golfer may be alerted to his torque generation by any number of means, electrical or nonelectrical. As an alternative to a bell or a light, the golfer could be alerted by the simple noise generated when the indicator block comes into contact with movement stop 14. Thus, electrical indicating means could be replaced by a simple click. Of course the golfer can also feel the movement of the platform when sufficient torque is generated so it is possible to provide and successfully use a device that has no audible or visual indicating means.

As is shown by holes 80 and 81, the stops can be moved into any number of a variety of positions in stop support 4. The purpose of such a a change would be to alter the distance between the stops and thereby change the distance the platform would need to rotate, and thus the tension required to rotate the platform so as to generate a signal by the indicating means. As was noted earlier, the tension of the adjusting means 58 can also be moved so as to alter the tension of spring 52. It should be readily apparent that by the movement of the stops and the adjustment of the springs, the range of torque necessary to generate an indicating signal can be greatly varied. It should also be readily apparent that the indicating scale 62 could be designed so as to readily accommodate both of these methods of adjusting the spring tension. Finally, although the described embodiment utilizes a relatively simple spring as a tension means, one ordinarily skilled in the art can easily utilize various sundry tensioning means to replace the spring. Further, it is contemplated that force sensing means may be used with appropriate indicating devices so that the actual torque may be indicated, visually or audibly or even recorded, without requiring any significant amount of rotation of the platform.

The preferred embodiment which has been set forth above is extremely flexible and can be altered in any one of a number of given ways without substantially altering the underlying concept. Thus, while the preferred embodiment of this invention has been described and illustrated, it is understood that this invention is susceptible of modifications within the sphere and scope of the claims.

What is claimed:

1. A golf practice device for a golfer, comprising: a base; a platform rotatably connected to the base for the golfer to stand on, the base remaining stationary when the platform rotates in a clockwise or a counterclockwise direction in a horizontal plane of rotation; a variable tensioning means connected to the platform for imposing a rotation retarding tension on the platform; a tension adjusting means connected to the variable tensioning means for selectively adjusting the rotation retarding tension; and means for limiting the rotation between the platform and base to a predetermined small angle achieved during a golf club swing for minimizing the the rotational movement of the golfer relative to the base and for providing a signal when a sufficient torque is applied to the platform to overcome said rotation retarding tension and rotate said platform said predetermined angle from rest.

2. A golf pratice device for a golfer, comprising: a base; a platform for the golfer to stand on; a rotatable mounting connected to the base and the platform, said mounting allowing the platform to rotate clockwise and counterclockwise in a horizontal plane, said base remaining stationary during such rotation; a tensioning means connected to the platform for providing resistance to the rotation of the platform in one direction; and a movement stop connected to the base, said movement stop preventing rotation of the platform beyond a predetermined small angle of rotation achieved during a golfing swing for minimizing rotation of the golfer, the small angle of rotation being measured from a resting position of the platform to a stopped position of the platform caused by said movement

3. The golf practice device as recited in claim 2, further comprising:

a resting stop connected to the base, and an extension on the platform contacting the resting stop when the platform is in the resting position and the movement stop in the stopped position.

4. The golf practice device as recited in claim 2, further comprising:

an indicator means for providing a signal when the platform has rotated from the resting position to the stopped position.

5. The golf practice device as recited in claim 4 wherein the indicator means includes an electrical circuit that is open in the resting position and is closed by movement to the stopped position, said electrical circuit including a first contact on the platform engageable with a second contact on the base in the stopped position.

6. The golf practice device as recited in claim 5 wherein the indicator means includes a light.

7. The golf practice device as recited in claim 5 wherein the indicator means includes an electrical noise generating means.

8. A golf practice device for use by a golfer to develop a proper and consistent torque through the body to the feet from the start of downswing, comprising, a base, a horizontal platform mounted on the base to pivot about a vertical axis and having space for positioning the golfer's feet on either side of said axis, means for resisting pivoting of said platform in response to the torque developed by the golfer's downswing, means for limiting the pivoting between the platform and base to a small amount responsive to said torque for minimizing the pivoting of the golfer relative to the base during a golfing swing and including means for indicating at least one predetermined magnitude of that torque when developed by the downswing for the golfer to practice achieving that magnitude of torque.

9. The device of claim 8 in which said pivot resisting means includes an adjustable means for selecting different predetermined magnitudes of torque resistance.

10. The device of claim 8 or 9 in which said indicating means includes a stop for allowing a preselected amount of pivoting when the said predetermined magnitude of torque is achieved.

11. The device of claim 8 or 9 in which said indicating means includes electrical means for producing a signal when the said predetermined magnitude of torque is achieved.

* * * * *

UNITED STATES PATENT AND TRADEMARK OFFICE

CERTIFICATE OF CORRECTION

PATENT NO. : 4,560,165

DATED : December 24, 1985

INVENTOR(S) : Frank Witteman et al.

It is certified that error appears in the above-identified patent and that said Letters Patent is hereby corrected as shown below:

Column 4, line 61, remove the extra "the"

Column 5, line 13, after "movement" insert -- stop . --.

Signed and Sealed this

First Day of April 1986

[SEAL]

*Attest:*

DONALD J. QUIGG

*Attesting Officer*

*Commissioner of Patents and Trademarks*